US005717763A

United States Patent [19]

Choi et al.

[11] Patent Number: 5,717,763

[45] Date of Patent: Feb. 10, 1998

[54] VOCAL MIX CIRCUIT

[75] Inventors: Jin-Sub Choi; Dong-Jin Keum, both of Kyounggi-do, Rep. of Korea

[73] Assignee: Samsung Electronics Co., Ltd., Kyungki-do, Rep. of Korea

[21] Appl. No.: 678,036

[22] Filed: Jul. 10, 1996

[30] Foreign Application Priority Data

Jul. 10, 1995 [KR] Rep. of Korea ..... 95-20178

[51] Int. Cl.[6] ..... H04S 1/00

[52] U.S. Cl. ..... 381/1; 381/97

[58] Field of Search ..... 381/1, 27, 28

[56] References Cited

U.S. PATENT DOCUMENTS 4,308,423 12/1981 Cohen ..... 381/1

5,197,100 3/1993 Shiraki ..... 381/27

*Primary Examiner*—Forester W. Isen

*Attorney, Agent, or Firm*—Cushman Darby & Cushman

[57] ABSTRACT

A vocal mix circuit shifts the phase of a mixed audio signal using a phase shifter, and achieves a mixed signal emphasizing the voice components thereof, by subtracting a signal which is not shifted from the signal shifted by the phase shifter. Gain through the above steps is controlled by the gain controller. Then, operators process both the initial signals and the signal through the phase shifter and the gain controller. Accordingly, the vocal mix circuit enables a person to hear with high sensitivity, has a simple circuit, and reduces the number of external pins.

4 Claims, 2 Drawing Sheets

VOCAL MIX CIRCUIT

BACKGROUND OF THE INVENTION

1. Field of the Invention

The present invention relates to a vocal mix circuit, and more particularly, to a vocal mix circuit which uses a phase shifter to perform a vocal mix function to emphasize the vocal band of an audio signal, thereby achieving a simple circuit.

2. Description of the Related Art

FIG. 1 is a block diagram of a conventional vocal mix circuit.

As shown in FIG. 1, the conventional vocal mix circuit includes a mixer 1 which receives two audio signals Lin and Rin as an input, and mixes them; a low pass filter 2 for passing a frequency band below a cut-off frequency after receiving the output signal of the mixer 1; a high pass filter 3 for passing a frequency band beyond the cut-off frequency after receiving the output signal of the mixer 1 as an input; an inverter 4 for inverting the phase of the output signal of the low pass filter 2; an operator 5 for creating a signal with an emphasized vocal band by subtracting the output signal of the high pass filter 3 from the output signal of the inverter 4; a gain controller 6 for controlling the gain of the emphasized vocal band signal after receiving the output signal of the operator 5 as an input; and mixers 7 and 8 for outputting the final signals Lout and Rout having an emphasized vocal band by adding the initial audio signals Lin and Rin to the output signal of the gain controller 6.

However, the conventional vocal mix circuit as described above has problems in that it is a complicated circuit, and has a large number of external pins.

SUMMARY OF THE INVENTION

An object of the present invention is to provide a vocal mix circuit which uses a phase shifter to perform a vocal mix function to emphasize a vocal band of an audio signal, thereby achieving a simple circuit, that is capable of solving the problem in the prior art.

In order to achieve this object, the present invention comprises a phase shifter for receiving two mixed audio signals as an input, and for shifting the phase of the input signal; and a vocal mixing means for outputting an audio signal having an emphasized vocal band characteristic by using both the mixed signal applied through the phase shifter and the original signals not passing the phase shifter.

The vocal mixing means includes a first operator for outputting the audio signal having an emphasized vocal band characteristic by subtracting the original signals not passing the phase shifter from the emphasized signal applied through the phase shifter;

a gain controller for controlling the gain of the emphasized vocal band signal after receiving the output signal of the first operator as an input; and second and third operators for outputting the final mixed vocal signal by subtracting the emphasized vocal band signal, outputted from the gain controller, from the initial audio signals.

The phase shifter includes a two-stage all pass filter for receiving two mixed audio signals Lin and Rin as an input, for transmitting the all frequency band, and for delaying the phase by 90° from the pole of each all pass.

The all pass filter includes first and second resistors, one terminal of each being commonly connected to an input terminal; an amplifier for amplifying a signal transmitted through the first and second resistors which have their other terminals respectively connected to the inverting and noninverting terminals of the amplifier; a capacitor connected to the noninverting terminal of the amplifier, a power supply, and a ground terminal; and a third resistor for controlling the output signal by connecting the noninverting terminal with the output terminal of the amplifier.

DETAILED DESCRIPTION OF THE PREFERRED EMBODIMENT

A preferred embodiment of the present invention will become apparent from a study of the following detailed description, when viewed in light of the accompanying drawings.

Figure 1:
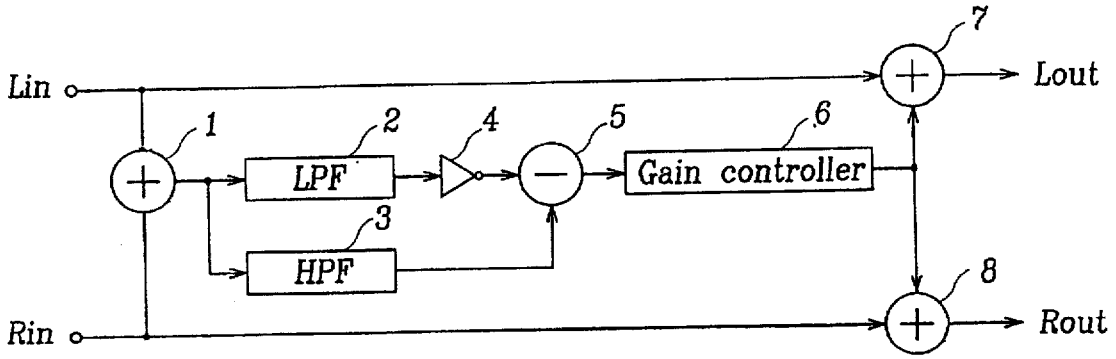
FIG. 1 (Prior Art)
FIG. 1 is a block diagram of a conventional vocal mix circuit.
Figure 2:
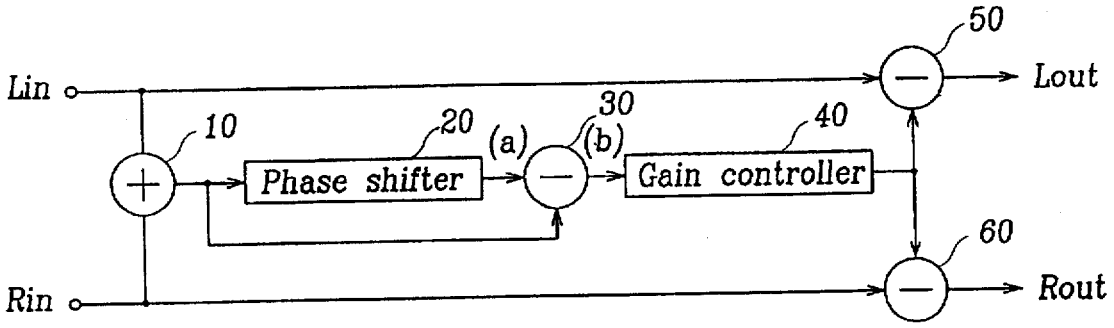
FIG. 2 is a vocal mix circuit in accordance with a preferred embodiment of the present invention.

As shown in FIG. 2, the vocal mix circuit according to a preferred embodiment of the present invention comprises a mixer 10 which receives two audio signals Lin and Rin as an input and mixes them; a phase shifter 20 for receiving the two mixed vocal signals, and shifting the phase thereof; an operator 30 for outputting a vocal signal having an emphasized vocal band characteristic, by subtracting the original signals not passing the phase shifter 20 from the emphasized vocal band signal applied through the phase shifter 20; a gain controller 40 for controlling the gain of the emphasized vocal signal, after receiving the output signal of the operator 30 as an input; and operators 50 and 60 for outputting the final audio signals Lout and Rout, having an emphasized vocal band, by subtracting the emphasized vocal band signal outputted from the gain controller 40 from the initial audio signals Lin and Rin.

Figure 3:
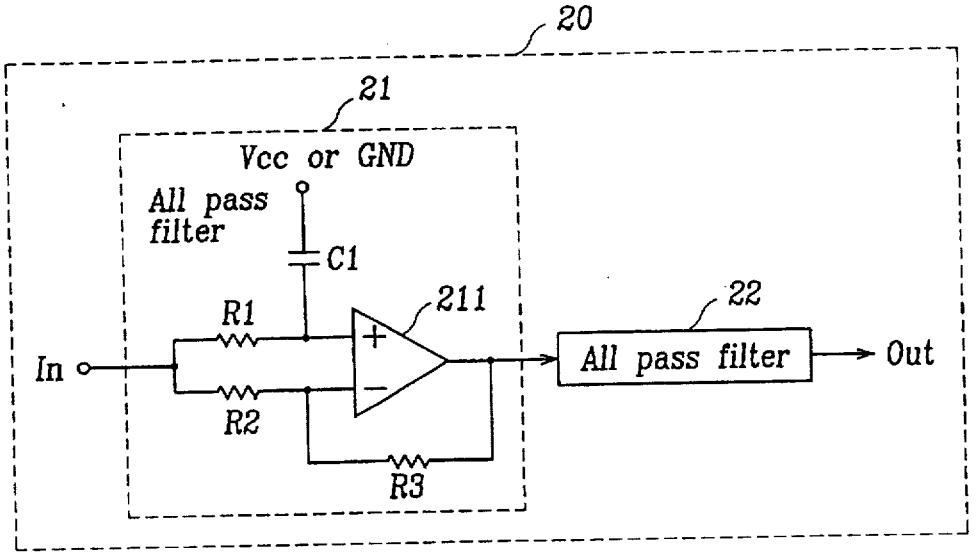
FIG. 3 is a detailed circuit diagram showing a phase shifter of a vocal mix circuit in accordance with the preferred embodiment of the present invention.

As shown in FIG. 3, the phase shifter 20 includes two all pass filter stages 21 and 22 for receiving two mixed vocal signals outputted from the mixer 10 as an input, for transmitting the all frequency band, and for delaying a phase by 90° from the pole of each all pass filter.

The all pass filter 21 includes resistors R1 and R2, both having one side terminal commonly connected to the input terminal In; an amplifier 211 for amplifying a signal transmitted through the resistors R1 and R2, which have their other side terminals respectively connected to the inverting (−) and noninverting (+) terminals thereof; a capacitor C1 for connecting the noninverting terminal (+) of the amplifier 211 with a power supply or a ground terminal Vcc or GND; and a resistor R3 for controlling the output signal by connecting the noninverting terminal (+) to the output terminal of the amplifier.

Figure 4:
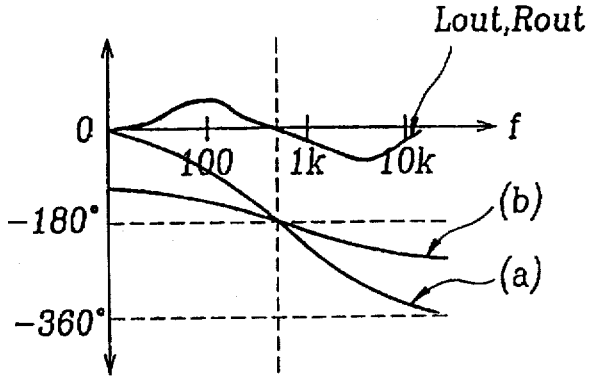
FIG. 4 is a phase characteristic curve of the vocal mix circuit in accordance with the preferred embodiment of the present invention.
Figure 5:
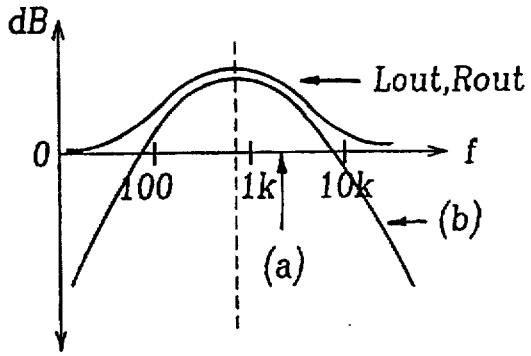
FIG. 5 is a gain characteristic curve of the vocal mix circuit in accordance with the preferred embodiment of the present invention.

The vocal mix circuit of FIG. 2, having the phase shifter 20 shown in FIG. 3, emphasizes the vocal band of an audio signal inputted thereto, and shows the phase characteristics of FIG. 4 as well as the gain characteristics of FIG. 5.

As shown in FIG. 2, two input signals Lin and Rin are inputted to the circuit, are mixed through the mixer 10, and then passed through the phase shifter 20 shown in FIG. 3. The phase shifter 20 is a general two-stage all pass filter 21, 22, and shows phase characteristics such as are expressed by the curve (a) of FIG. 4 as well as the gain characteristics such as are expressed by the curve (a) of FIG. 5.

Next, when the operator 30, making a signal which emphasizes a voice band, subtracts the initial signal not passing the phase shifter 20 from the mixed signal which does pass through the phase shifter 20, the vocal mixed signal passing through the operator 30 shows phase characteristics such as are expressed by the curve (b) of FIG. 4 as well as gain characteristics emphasized such as are expressed by the curve (b) of FIG. 5, because the phase of the mixed signal through the phase shifter 20 is shifted with respect to that not passing the phase shifter 20, as shown in curve (b) of FIG. 4.

The gain controller 40 controls the voice magnitude by controlling the magnitude of a mixed signal of which the vocal band is emphasized. This is referred to below as a vocal mix signal. When the operators 50 and 60 subtract a signal having an emphasized vocal band from the original signals Lin and Rin, the vocal mix circuit shows the phase characteristics such as a curve Lout or Rout of FIG. 4 as well as the gain characteristics emphasizing the vocal band such as a curve Lout or Rout of FIG. 5, because the phase of the signal having the emphasized vocal band is shifted with respect to the original signals Lin and Rin as shown in the curve (b) of FIG. 4.

As described above, the vocal mix circuit shifts the phase of the mixed signal by using the phase shifter 20, and achieves a mixed signal which emphasizes the voice components by subtracting a signal which is not shifted from the signal shifted by the phase shifter. Gain through the above steps is controlled by the gain controller 40. Then, the operators 50 and 60 process both initial signals Lin and Rin and the signal through the phase shifter 20 and the gain controller 40. As a result, the vocal mix circuit enables a person to hear with high sensitivity.

In conclusion, according to a preferred embodiment of the present invention, the vocal mix circuit uses a phase shifter to perform a vocal mix function to emphasize the vocal band of an audio signal thereby achieving a simple circuit.

Although the present invention has been described in detail with reference to the preferred embodiments thereof, those skilled in the art will readily appreciate that various substitutions and modifications can be made thereto without departing from the spirit and scope of the invention as set forth in the appended claims.

What is claimed is:

1. A vocal mix circuit, comprising:

a mixer which mixes two audio signals;

an all pass filter stage which shifts a phase of a mixed signal from said mixer while all frequencies of said mixed signal;

a first operator which subtracts said mixed signal from a phase-shifted signal from said all pass filter stage;

a gain controller which controls a gain of an output signal of said first operator; and second and third operators whose outputs respectively correspond to said two audio signals with an emphasized vocal band characteristic by subtracting an output signal of said gain controller from said two audio signals, respectively.

2. The vocal mix circuit as defined in claim 1, wherein said all pass filter stage comprises:

two all pass filters which transmit all frequencies of said mixed signal from said mixer and which each shift said phase of said mixed signal by 90° with respect to a vocal band.

3. The vocal mix circuit as defined in claim 2, wherein each of said all pass filters include:

first and second resistors, each having two terminals, one of said two terminals connected with an input pad, respectively;

an amplifier which amplifies a signal transmitted by said resistors, having a non-inverting terminal and an inverting terminal connected with the other of said two terminals of said resistors, respectively;

a capacitor connected between said non-inverting terminal and a power line; and a third resistor connected between said inverting terminal and an output pad.

4. A vocal mix circuit, comprising:

a mixer which mixes two audio signals;

an all pass filter stage which shifts a phase of a mixed signal from said mixer while passing all frequencies of said mixed signal, said all pass filter stage including two all pass filters which transmit all frequencies of said mixed signal from said mixer and which each shift said phase of said mixed signal by 90° with respect to a vocal band;

a controller circuit which outputs two signals which respectively correspond to said two audio signals with an emphasized vocal band characteristic by combining said mixed signal applied through said all pass filter stage with said two audio signals, respectively.

* * * * *